US005586666A

United States Patent [19]

Squitieri

[11] Patent Number: 5,586,666

[45] Date of Patent: Dec. 24, 1996

[54] FOLDABLE AND EXPANDABLE PROMOTIONAL PALLET

[75] Inventor: Anthony C. Squitieri, Monroe, Conn.

[73] Assignee: Mechtronics Corporation, Stamford, Conn.

[21] Appl. No.: 489,441

[22] Filed: Jun. 12, 1995

[51] Int. Cl.[6] ..... A47F 5/00

[52] U.S. Cl. ..... 211/175; 211/195; 108/54.1; 248/346.02; 248/346.3

[58] Field of Search ..... 211/175, 198, 211/195; 108/54.1; 248/346.01, 346.02, 346.06, 346.3

[56] References Cited

U.S. PATENT DOCUMENTS

| | | | |
|---|---|---|---|
| 2,679,321 | 5/1954 | Koeferl | 211/195 X |
| 3,977,333 | 8/1976 | Phillips | 108/54.1 |
| 4,178,844 | 12/1979 | Ward et al. | 211/175 X |
| 4,181,221 | 1/1980 | Tennant | 211/195 X |
| 4,553,523 | 11/1985 | Stohrer | 211/175 X |
| 4,638,744 | 1/1987 | Clive-Smith | 248/346.3 X |
| 5,137,160 | 8/1992 | Santucci | 211/175 X |

*Primary Examiner*—Robert W. Gibson, Jr.

*Attorney, Agent, or Firm*—Dale L. Carlson; Haynes N. Johnson

[57] ABSTRACT

A promotional pallet which can be varied in both length and width, and which will have places for signs and pennants in any of its configurations. Its length is changed by using two sections each formed by a pair of base members with interengaging fingers and in which the extent of interengagement can be varied. The fingers slidingly interengage in a "cantilever" manner so as to provide structural strength regardless of length. The width of the pallet is changed by using two sets of sections of equal width hinged together with hinges which can accommodate change in length, while at the same time permitting flush overlapping of two sets of sections, so the weight being carried is distributed uniformly over a common surface. The front and one side of each set of sections can each carry a sign providing product or brand information; one sign will block the other when the sections are hinged together in overlapping relationship, since with this reduced width only one sign is necessary, and, also, to avoid having one sign being displayed upside down.

20 Claims, 5 Drawing Sheets

FOLDABLE AND EXPANDABLE PROMOTIONAL PALLET

FIELD OF THE INVENTION

This invention relates to the field of pallets, and, in particular, to promotional pallets with adjustable size which can be used to display and advertise goods in a retail store, such as a supermarket.

BACKGROUND OF THE INVENTION

Promotional pallets normally come in a single size, thus requiring the user to have an inventory of different sizes if he wishes to use different sizes in different situations. This can be remedied by having, as here, a pallet which is adjustable in size. Such a pallet must, however, have structural strength in all of its sizes in order to be practical; and it must have convenient method for displaying promotional material.

Shelving has been made to be adjustable to a limited extent, as shown, for example, in Squitieri U.S. Pat. No. 5,295,596 on "In-Store Display Having Variable Width." I do not believe, however, that such a structure has been used for promotional pallets, nor have pallets been foldable as well as extensible, to vary their size both in length and width.

BRIEF SUMMARY OF THE INVENTION

I have invented a promotional pallet which can change in both length and width. Its length is changed by using two sections with interengaging fingers and in which the extent of interengagement can be varied. The fingers interengage in such a manner as to provide structural strength regardless of length. Its width can be changed by using two similar sets of sections hinged together with hinges which can accommodate change in length as well as permitting flush overlapping of two sets of sections, with the weight being carried distributed uniformly over a common surface.

The front and one side of each set of sections can carry a sign to carry product or brand information. The signs on one section will block the signs on the other section when the sections are hinged together in overlapping relationship, since with this reduced width only one sign is necessary, and, also, to avoid having one of the signs being displayed upside down.

DETAILED DESCRIPTION OF THE INVENTION

Figure 2:
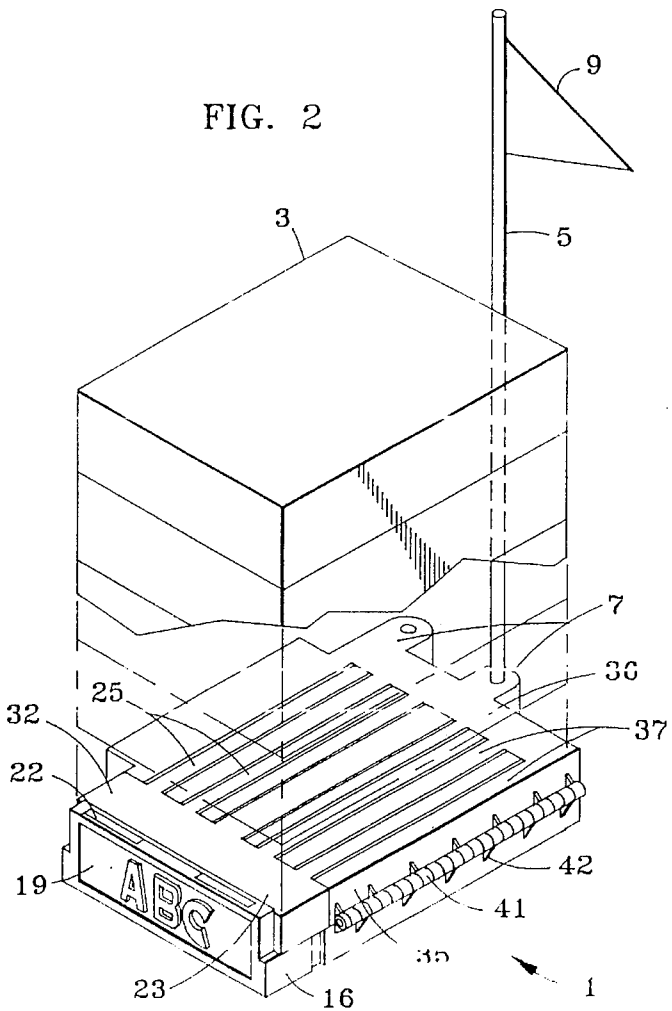
FIG. 2 is similar to FIG. 1, but showing the pallet in its smallest size.

Promotional pallet 1 is designed to be adjusted to various sizes and to be used to display cases 3 of soda or beer in a retail store, such as a supermarket. It may, if desired, carry stanchions 5 in stanchion holders 7 to display attention-getting pennants 9.

Pallet 1 is made up of four principal base members: left front base member 15, with end piece 16 and fingers 17; right front base member 23, with end piece 23 and fingers 25; left rear base member 31, with end piece 32 and fingers 33; and right rear base member 35, with end piece 36 and fingers 37. In each instance, the fingers extend from their respective end pieces. Fingers 17 of left front base member 15 complement and slidingly interengage with fingers 33 of left rear base member 31; and fingers 25 of right front base member 23 complement and slidingly interengage with fingers 37 of right rear base member 35.

Figure 1:
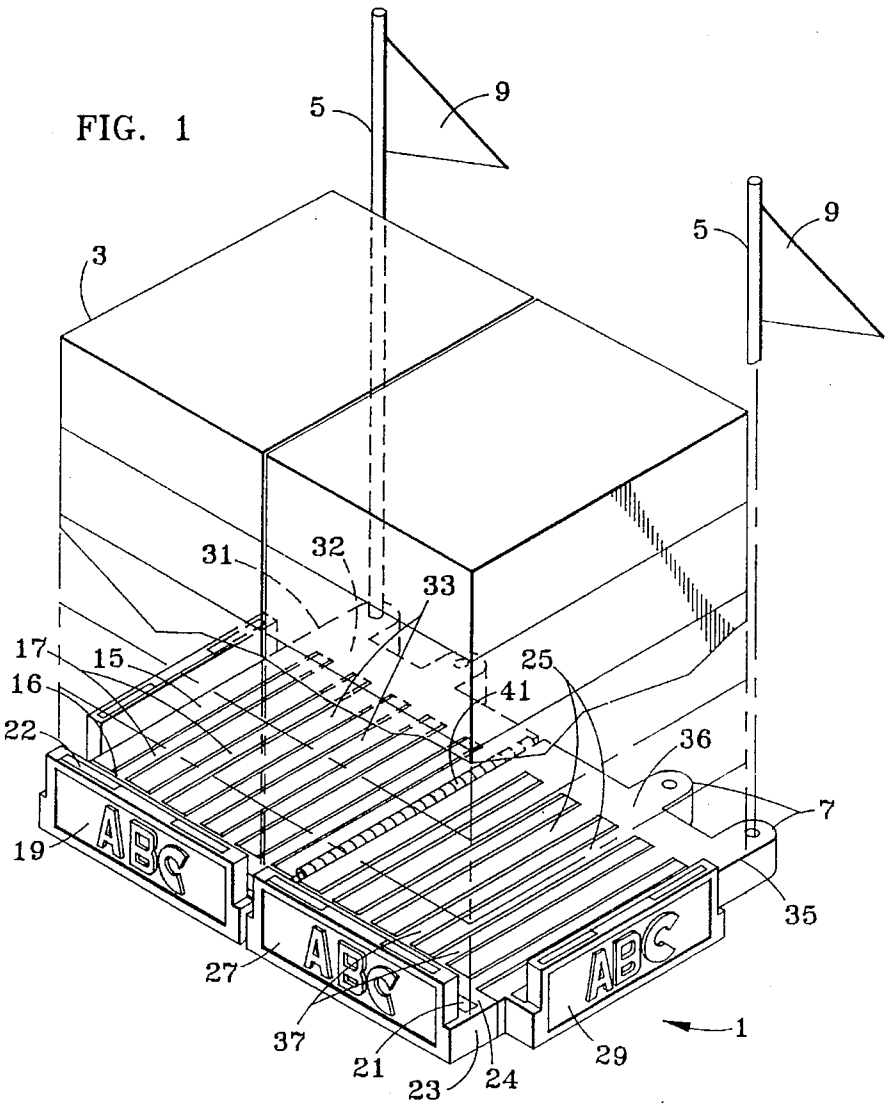
FIG. 1 is a perspective view of my pallet, partially broken away, showing the pallet in an intermediate size, in its shortest length and greatest width, and with cases of soda or beer on it.
Figure 3:
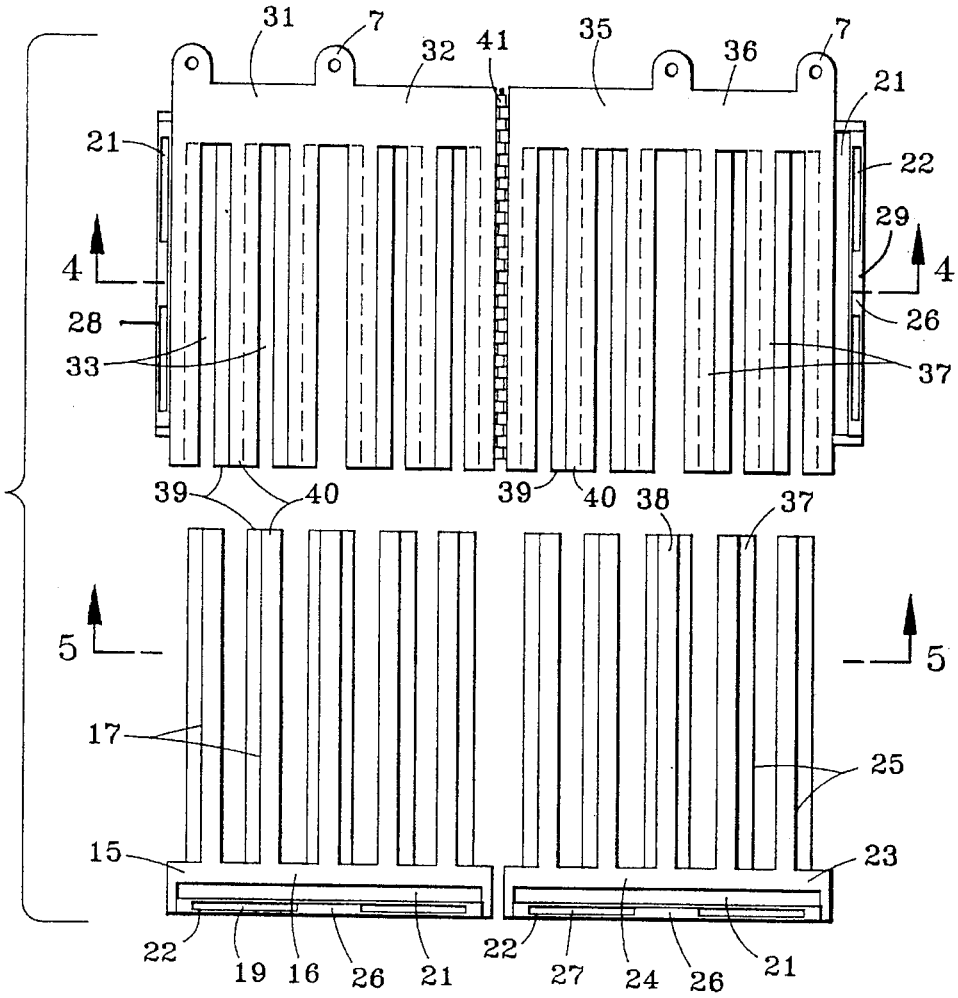
FIG. 3 is an exploded plan view of the pallet.
Figure 4:
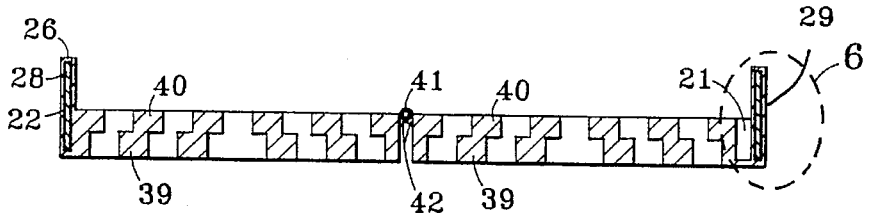
FIG. 4 is a vertical section, taken on line 4—4 of FIG. 3.
Figure 5:
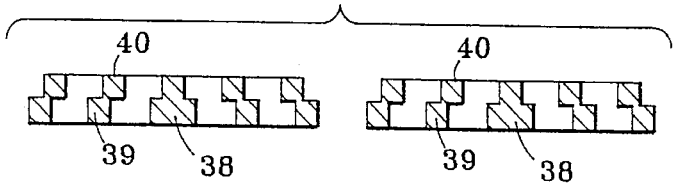
FIG. 5 is a vertical section, taken on line 5—5 of FIG. 3.
Figure 6:
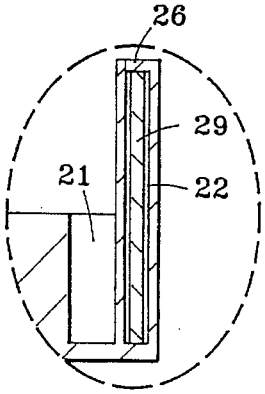
FIG. 6 is an enlargement of the circled area 6 in FIG. 4, showing details of the side sign holder
Figure 7:
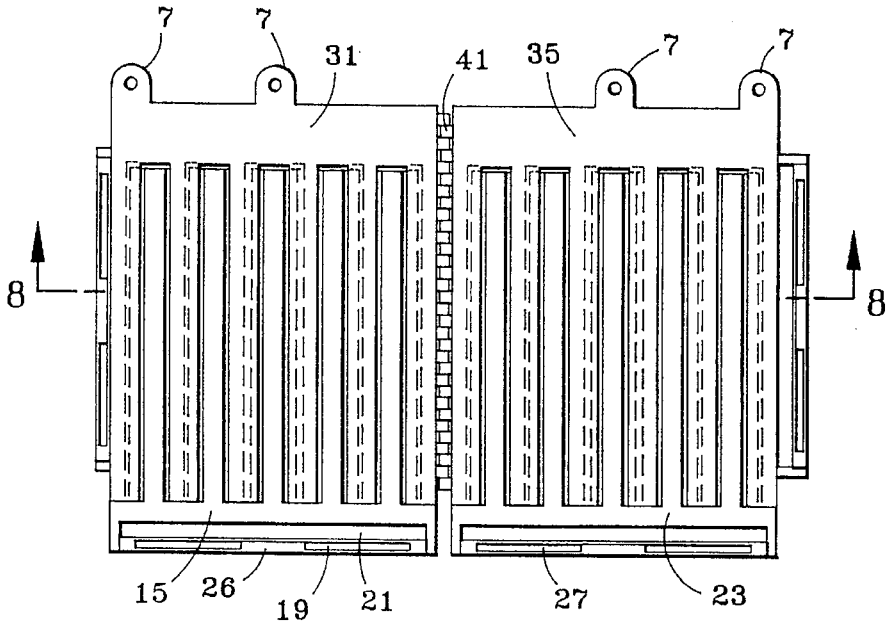
FIG. 7 is a plan view of the pallet at its maximum width and shortest length.
Figure 9:
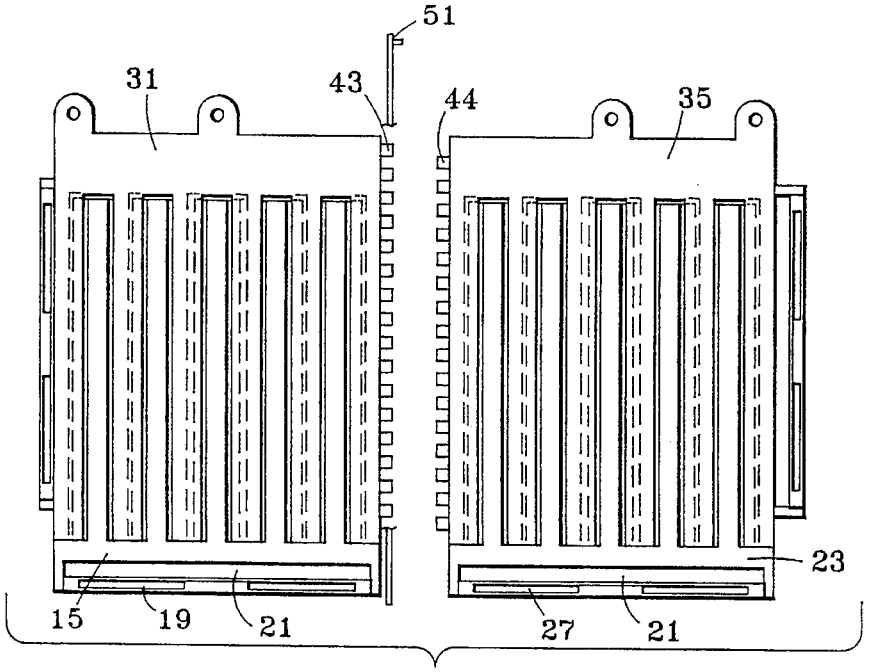
FIG. 9 is an exploded plan view of the pallet of FIG. 7, showing details of the hinge used.
Figure 10:
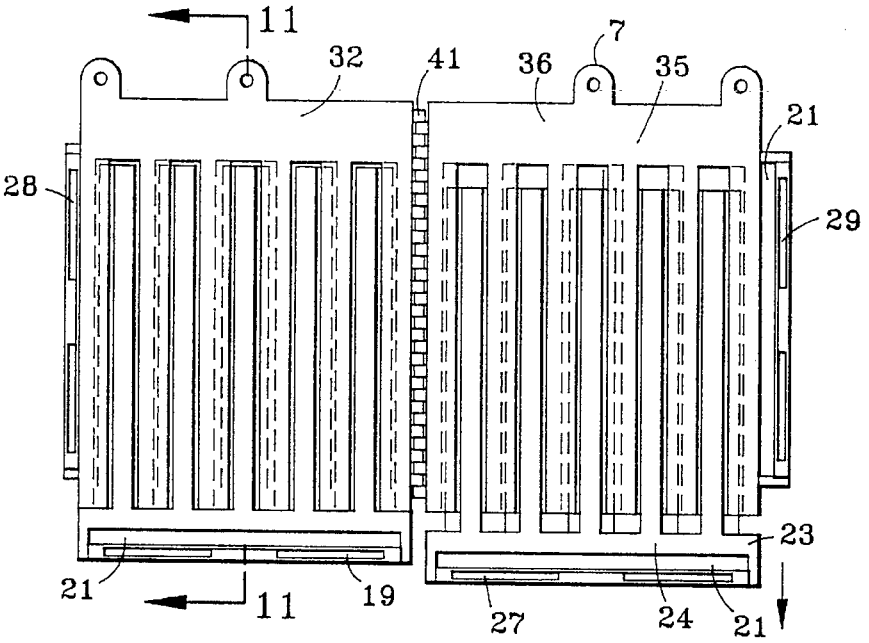
FIG. 10 is a plan view of the pallet of FIG. 7, showing how the lengths of the two pallets can be varied to provide for one front sign to go behind the other when the pallet is folded.
Figure 11:
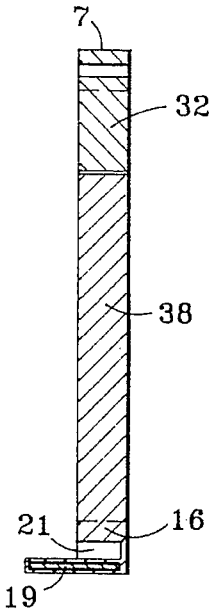
FIG. 11 is a section, taken on line 11—11 of FIG. 10.
Figure 12:
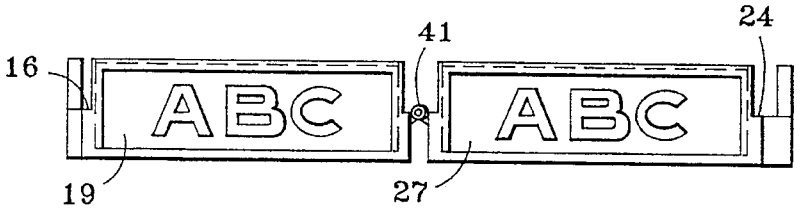
FIG. 12 is a front elevation of the pallet in its unfolded position.
Figure 14:
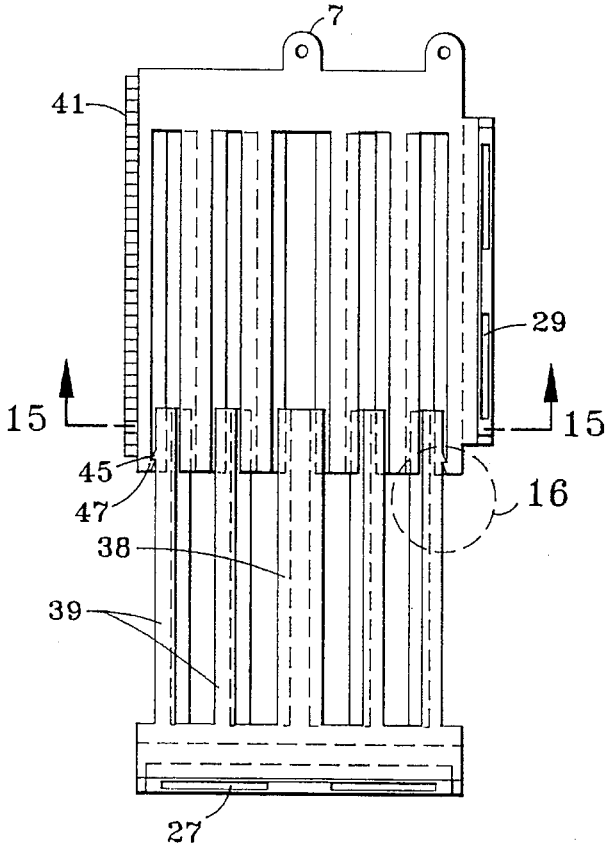
FIG. 14 is a plan view of a single section extended to about its greatest length.

Left rear base member 31 and right rear base member 35 are hinged together by hinge 41. Hinge 41 includes hinge knuckles 43 on one base member, complementary hinge knuckles 44 on the other base member, and a joining rod 51 passing through the hinge knuckles (FIG. 9). The knuckles may have hinge reinforcements 42 (FIG. 2) Thus, when the respective knuckles of the rear base members are interengaged, and rod 51 inserted, the rear base members 31 and 35 form a unitary hinged section. This permits having a wide pallet ( See FIGS. 1 and 8) or a narrow pallet (See FIGS. 2 and 15). To this end, the hinge 41 is mounted along the top edges of the respective members, so that when the pallet is folded, the entire top surface, formed of the left front and rear base members 15 and 31, contacts the entire top surface, formed of the right front and rear base members 23 and 35, providing for the best support and for the best stability. It will be noted that this occurs whether the fingers of the front and rear base members are fully interengaged (shortest length from front to back; FIG. 10), are only slightly interengaged (longest length; FIG. 14), or somewhere in between. As can be seen, each pallet is formed of a plurality of sections of front and rear base members, with interengaged fingers and hinges along at least one edge. The hinges on each section are at a top or bottom edge, and are pivoted in the plane of the surface. Preferably, the sections are of the same width.

Thus, the length of the pallet can be varied by varying the extent of interengagement of the fingers; and the width can be varied by having the pallet open or hinged closed.

Figure 13:
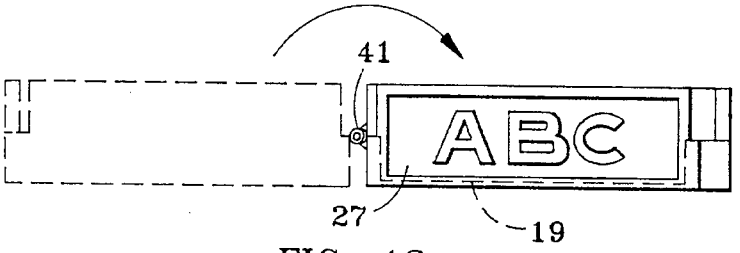
FIG. 13 is similar to FIG. 12, showing how the signs on the front ends fit with one behind the other when the pallet is folded.

The front ends of the left front and right front base members 15 and 23 can, if desired, each carry a sign with advertising matter, brand name, or the like. Thus, left front member 15 would carry sign 19; and right front member 23 would carry sign 27. When the pallets are folded, one section is made slightly longer than the other (FIG. 10), so one sign can go behind the other (FIG. 13). Either side can carry the sign nearest the front, but, as shown, sign 19 is slightly behind sign 27 (the signs are offset with respect to one another); and there is a sign pocket or space 21 behind sign 27 to hide sign 19 (See FIGS. 10 to 13). In this way, sign 19, which would be upside down, will not be seen when the pallet is in its narrow width.

Figure 15:
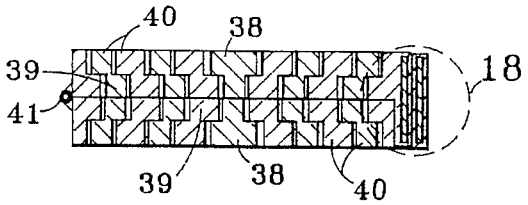
FIG. 15 is a section taken on line 15—15 of FIG. 14.
Figure 18:
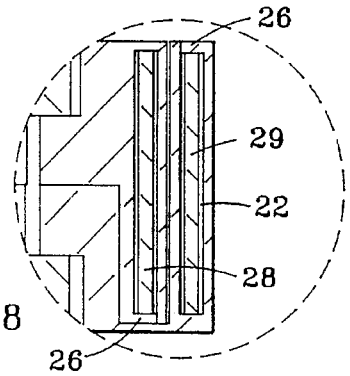
FIG. 18 is an enlargement of the area in circle 18 of FIG. 15 showing how the side signs interfit when the pallet is folded.

Additional signs 28 and 29 can be positioned on the sides of left and right rear base members 31 and 35, respectively (FIGS. 1, 3, 4, 6, and 8). One of these is more removed from the base member than is the other, so that it can have a sign pocket 21 behind it (FIGS. 3, 4, and 6) to receive the other sign when one base member is folded over the other base member (FIGS. 15 and 18). As a result, a sign which would be upside down can be hidden from view.

The signs which I have been referring to can be signs attached to the respective base members, but I prefer that they be removable, and so changeable. This is accomplished by having frames to hold the signs with a space 22 for the sign within the frame, a slit at the top to receive the sign, and a flexible flap 26 to hold the signs in place in the frame.

The fingers of the front base members are dimensioned for complementary fit with the respective fingers of the rear base members Thus, the fingers 17 of left front base member 15 extend from end piece 16 and interengage alternately with fingers 33 extending from end piece 32 of left rear base member 31; and, similarly, fingers 25 extend from end piece 24 of right front base member 23 and interengage alternately with fingers 37 extending from end piece 36 of right rear base member 31. The fingers slidingly interengage, permitting adjustment of the length of the pallet.

Figure 8:
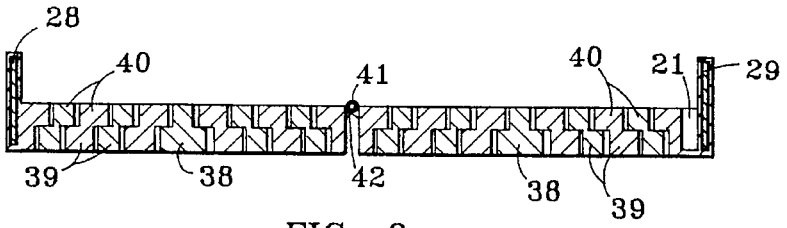
FIG. 8 s a vertical section, taken on line 8—8 of FIG. 7.
Figure 16:
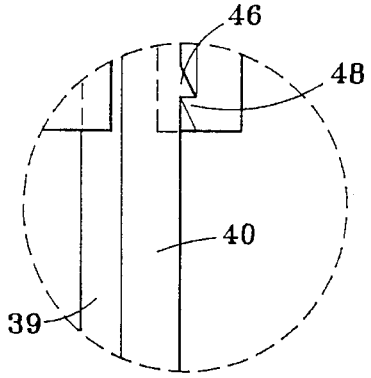
FIG. 16 is an enlargement of the area in circle 16 of FIG. 14, showing the stop members (locking tabs) which prevent the two parts of a section from separating. Here, the section has been enlarged to its greatest length.
Figure 17:
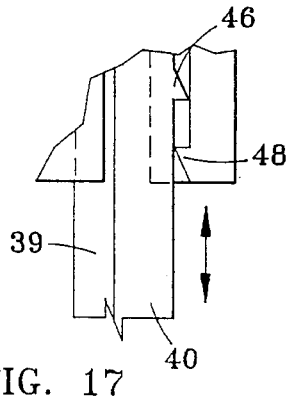
FIG. 17 is similar to FIG. 16, but with the section of shorter length.

Though other shapes of fingers can be used, good stability between front and rear base members is achieved by having the fingers shaped as seen in FIG. 8. Here, all or many of the fingers have a cross-section made up of a base 39 and an upper "cantilevered" shelf 40, having what may be called a Z-shaped cross-section, as disclosed in my patent 5,295,596. This cantilevering results in the shelf of one finger projecting over a portion of the base of an adjacent finger. This gives the unit more integrity, with no vertical slot running from the top to the bottom of the fingers. It also prevents the fingers from getting out of parallelism, which would be undesirable because it would leave an uneven surface. One can also have a double-stepped finger 38 extending centrally among the fingers, with cantilevered shelves 40 extending in opposite directions on the two sides of double-stepped finger 38, providing greater stability. It is desirable that the front and rear base members not be able to be separated. To this end, pairs of opposing locking tabs or stop members 45 and 47, and 46 and 48, are formed in the ends of the outer two pairs of fingers (FIGS. 14, 16, and 17).

Accordingly, I have provided a promotional pallet made up of a pair of front and rear sections of adjustable length, and hinged together. The pallet can be either of two widths, depending upon whether or not it is folded, and can be of different lengths from front to rear, depending upon the extent to which the front and rear fingers are interengaged.

I claim:

1. A pallet which is adjustable in both length and width, said pallet including left front, right front, left rear, and right rear base members, each said base member having an end piece with parallel fingers extending therefrom, said fingers on said left front and said left rear base members being interengaged with one another, said fingers on said right front and said right rear base members being interengaged with one another, and said left rear and said right rear base members being hinged together, said hinging being on a hinge axis, whereby said base members can hingedly fold over one another.

2. A pallet as set forth in claim 1 in which said hinge axis is in the plane of a surface of said pallet.

3. A pallet as set forth in claim 2 in which said hinge axis is on the upper said surface of said pallets when said base members are not folded over one another.

4. A pallet as set forth in claim 1 in which said fingers are Z-shaped whereby interengaging fingers are cantilevered with respect to one another.

5. A pallet as set forth in claim 4 including a central stepping finger in each said pair of front and rear base sections, with said fingers on one side of said stepping finger being cantilevered in a direction opposite to said fingers on the other side of said stepping finger.

6. A pallet as set forth in claim 1 including a sign positioned on said end piece of at least one of said front base members.

7. A pallet as set forth in claim 6 including a sign positioned on said end pieces of both of said front base members.

8. A pallet as set forth in claim 7 including a pocket behind one of said signs to receive the other of said signs.

9. A pallet as set forth in claim 1 including a side sign on the side of at least one of said base members.

10. A pallet as set forth in claim 9 including said side signs on a side of each of said rear base members.

11. A pallet as set forth in claim 1 including at least one stanchion holder mounted on one of said base members.

12. A pallet as set forth in claim 1 including stop means preventing complete separation of said left front and rear base members and of said right front and rear base members.

13. A pallet as set forth in claim 12 in which said stop means are locking tabs on adjacent fingers of said respective base members.

14. A pallet which is adjustable in both length and width, said pallet including a pair of sections, each said section including a front and a rear base member, each said base member having an end piece with parallel fingers extending therefrom, said fingers on each said front base member complementing and interengaging with said fingers on its respective said rear base member, whereby the position of said fingers on said front base member can be slidingly moved with respect to said fingers on said rear base member to vary the length of said section, and said sections being hinged together, whereby said sections can be folded over one another.

15. A pallet as set forth in claim 10 in which said sections are hinged at said rear base members.

16. A pallet as set forth in claim 15 in which said rear base members are hinged together in the plane of the upper surfaces of said rear base members.

17. A pallet as set forth in claim 14 in which said sections all have the same width.

18. A pallet as set forth in claim 14 including a sign mounted on said end piece of at least one said front base member.

19. A pallet as set forth in claim 18 including a sign mounted on each said end piece of each said front base member.

20. A pallet as set forth in claim 19 including a pocket behind one said sign to receive the other said sign.

* * * * *